US009362662B2

(12) United States Patent
McKay

(10) Patent No.: US 9,362,662 B2
(45) Date of Patent: Jun. 7, 2016

(54) SUBSEA ELECTRICAL CONNECTOR

(75) Inventor: David Ernest McKay, Stonehaven (GB)

(73) Assignee: SUBSEA TECHNOLOGIES LIMITED, Aberdeen (GB)

( * ) Notice: Subject to any disclaimer, the term of this patent is extended or adjusted under 35 U.S.C. 154(b) by 211 days.

(21) Appl. No.: 14/111,511

(22) PCT Filed: Apr. 13, 2012

(86) PCT No.: PCT/GB2012/050825

§ 371 (c)(1),
(2), (4) Date: Dec. 5, 2013

(87) PCT Pub. No.: WO2012/140443

PCT Pub. Date: Oct. 18, 2012

(65) Prior Publication Data

US 2014/0094051 A1 Apr. 3, 2014

(30) Foreign Application Priority Data

Apr. 13, 2011 (GB) ..... 1106267.6

(51) Int. Cl.
*H01R 13/627* (2006.01)
*H01R 13/523* (2006.01)
*H01R 13/629* (2006.01)

(52) U.S. Cl.
CPC ..... *H01R 13/523* (2013.01); *H01R 13/627* (2013.01); *H01R 13/62933* (2013.01)

(58) Field of Classification Search
CPC ..... H01R 13/6272
USPC ..... 439/352, 191, 372; 200/50.03
See application file for complete search history.

(56) References Cited

U.S. PATENT DOCUMENTS 1,818,290 A * 8/1931 Wulle ..... H01R 13/707 200/50.3
3,345,604 A * 10/1967 Henschen ..... H01R 13/62933 439/310

(Continued)

FOREIGN PATENT DOCUMENTS

AT 169521 B 11/1951
DE 10215069 A1 10/2003

(Continued)

OTHER PUBLICATIONS

Corrales, Daniel, "International Search Report," prepared for PCT/GB2012/050825, as mailed Aug. 6, 2012, 3 pages.

*Primary Examiner* — Neil Abrams
(74) *Attorney, Agent, or Firm* — Winstead PC

(57) ABSTRACT

A connector for connecting power or control systems infrastructure such as for example subsea infrastructure, said connector comprises a male component and a female component, the male and female components comprising cooperating mating surfaces and means for locking the male and female components together, the locking means being retractably mounted within one of the male or female components but extendible from that component into the other of the male or female components to lock the two components together against axial and rotational movement while providing a snag free release when the locking means is in the retracted position. The means for locking includes pivotal levers with free ends that are to enter recesses of the male component and that are to be held in locking position by a moveable control coupler. An electrical coupler located within the female component is to be raised to engage a corresponding coupler on the locked in position male component.

32 Claims, 11 Drawing Sheets

(56) References Cited

U.S. PATENT DOCUMENTS 3,529,276 A * 9/1970 Hennessey, Jr. ..... H01R 13/627 439/310
3,551,005 A * 12/1970 Brun ..... E21B 33/038 166/341
4,438,996 A * 3/1984 Zehren ..... H01R 13/523 166/65.1
4,453,793 A 6/1984 Panek et al.
4,525,918 A * 7/1985 Puritz ..... B23B 31/1074 279/89
4,915,642 A * 4/1990 Lin ..... H01R 13/627 439/350
4,932,887 A * 6/1990 Kataoka ..... G21D 1/02 439/198
4,940,414 A * 7/1990 Lee ..... H04B 1/082 439/131
5,048,914 A * 9/1991 Sneddon ..... H01R 13/7038 385/24
5,637,010 A * 6/1997 Jost ..... H01R 13/6277 439/352
6,530,794 B2 * 3/2003 Littlewood ..... H01R 13/523 439/265
6,974,341 B2 * 12/2005 Jennings ..... H01R 13/523 439/140
7,824,203 B2 * 11/2010 Littlewood ..... H01R 13/629 439/265
7,955,111 B2 * 6/2011 Costabel ..... F16B 5/0628 439/287
8,317,234 B2 * 11/2012 McKay ..... E21B 33/038 285/18
8,550,169 B2 * 10/2013 McKay ..... E21B 17/085 166/343
2014/0094051 A1 * 4/2014 McKay ..... H01R 13/523 439/345

FOREIGN PATENT DOCUMENTS

FR 2877509 A1 5/2006
GB 2214004 A 8/1989
GB 2359200 A 8/2001

* cited by examiner

SUBSEA ELECTRICAL CONNECTOR

This invention relates to a connector and more particularly to a connector for connecting infrastructure on the sea bed to surface processing equipment to provide electrical power and control systems for subsea infrastructure.

Increasingly infrastructure is being deployed to the seabed that is based on electrical power and control systems. The electrical power can be used in various ways including supplying power directly to some form of electrical motor for example, or to power the prime mover to drive ancillary items such as hydraulic motors which in turn generate hydraulic power subsea. In all cases an element of control functionality is generally required to control the deployed equipment and gather data from sensors on its performance/condition.

In some cases the hardware may be deployed subsea by a separate hoist cable and the electrical power cable is then deployed separately and connected by an ROV. In other cases an electrical cable is used which has an integral tensile capacity in which case the payload can be deployed on the power line itself. In both cases when connected and operational subsea the vessel is connected to the subsea cable by the electrical line/connection. In the event that the vessel were to lose position for whatever reason there is the danger that the line is drawn taught as the vessel moves off station leading to failure of the cable, or the deployed payload being dragged across the seabed so causing damage to any surrounding infrastructure. In all cases the deployed unit will have connection to some other structure such as Xmas tree, template, subsea processing plant etc. which could also be compromised.

In some cases the electrical connection to the subsea unit will be by means of a submersible (but dry mate) connector. Such an arrangement has no means of subsea disconnect/connect and so is effectively a fixed connection with no realistic method for emergency quick disconnect (EQD). Other connections are commonly made with "wet mateable" electrical connectors that can be disconnected/connected subsea. These are generally connected to the subsea unit by means of stab plates, diver makeup or ROV make up.

Stab plate applications generally have the mating electrical parts mounted on two mating plates which locate together with guide pins and are then secured by some mechanical means. Although a stab plate could be arranged to disconnect subsea it generally requires a certain amount of axial movement along the axis of the couplers before the plates can separate. This places distinct limitations on configuring a disconnect that can release reliably regardless of the line of action of the line.

Diver makeup is not a realistic option for any sort of EQD functionality.

ROV makeup generally requires a linear movement to connect/disconnect similar to the movement required for a stab plate application. This places the same limitations on EQD functionality. In any case use of an ROV as a means of EQD is not a practical solution.

In each of the cases above a connection could be configured such that the initial connection could be achieved by either vertical stab plate, diver or ROV, and the EQD functionality build into the unit and functioned by a control signal with the connection being forced apart by means of hydraulic cylinders or springs for example. In this case the separation would still require an initial linear movement along the axis of the connector before the connection would be clear.

One possible method would be to have the unit simply release the electrical connector and allow the line to pull it clear as it becomes taught. This is extremely limiting as it requires the line of action of the electrical cable to be largely along the axis of the connectors (until they are free). Another option is for the unit to forcibly "eject" the electrical connector. This would require a system that was capable of ejecting the connector clear of any interface between the two halves that might interfere with subsequent pull clear of the connector.

In both of the two scenarios above the line of action of the line relative to the connector would be crucial. For the "pull out" example a point would be reached where the angle of the cable either prevented the connector coming apart or damaged the connector/cable in the process. Similarly for the "eject" scenario any off centre pull by the cable would impart a side pull on the interface and interfere with the eject function. Potentially the line could be becoming taught in the opposite direction from the eject travel and so prevent the eject function completely.

A similar scenario exists for any flexible cable connected to equipment on the seabed. Although the invention described and illustrated shows the STL connector configured with an electrical connector is equally be configured with hydraulic connection passing across the interface. As such the overall connector assembly could have wide ranging applications.

According to a first aspect of the present invention there is provided a connector for connecting power or control systems infrastructure such as for example subsea infrastructure, said connector comprising a male component and a female component, the male and female components comprising cooperating mating surfaces and means for locking the male and female components together, the locking means being retractably mounted within one of the male or female components but extendible from that component into the other of the male or female components to lock the two components together against axial and rotational movement whilst providing a snag free release when the locking means is in the retracted position.

Preferably one of the male component or female components has a convex mating surface and the other has a concave mating surface.

Preferably also the mating surfaces of the male and female components of the connector are partly spherical. Alternatively the mating surfaces of the male and female components may be substantially flat.

Preferably the mating surface of one of the male or female components comprising a convex surface and the other of the male and female components comprising a concave surface.

When the mating surfaces of the male and female components of the connector are convex and concave, the male component can be quickly and easily released from the female component regardless of the orientation of the connecting cable of the male component or the amount of tension applied at the point when an emergency disconnect of the connector is required. This addresses both safety issues and also prevents damage to the components of the connector during such an emergency procedure.

Preferably the male component of the connector has a convex mating surface and the female component has a concave mating surface.

Advantageously, the mating surfaces of the male and female components of the connector are partly spherical.

Preferably the connector further comprises latching means for mechanically latching the male and female components together.

Preferably the latching means comprises a lever pivotally mounted on the connector.

Advantageously the lever is mounted on the female component of the connector.

Preferably apertures are formed in the mating surface of the female connector.

Advantageously the lever is adapted for movement between a locked condition in which the lever extends through the aperture in the mating surface of the female connector and an unlocked condition in which the lever is retracted from the aperture.

Conveniently a groove is formed in the outer surface of the male member.

Preferably the groove is formed in the mating surface of the male member.

Conveniently when the male and female components are connected, the lever is adapted to extend, by a biased force, through the aperture in the female member and into the groove of the male member. The force on the lever is sufficient to maintain the lever in the locked condition to prevent axial disengagement of the male and female members.

Advantageously a recess is provided in the groove, the end of the lever being received in the recess to lock the male and female members together against radial movement.

Preferably means are provided for applying a biasing force to the lever. Advantageously the means for applying the biasing force may act on the lever in one direction in a first condition and in another, preferably opposite direction in a second condition.

Preferably the depth of the groove increases within the recess.

Preferably the connector further comprises actuation means.

Conveniently the actuation means comprises a housing which is preferably mounted within the body of the female component.

Advantageously the housing is adapted to be raised and lowered within the body of the female component.

Conveniently a first portion of the housing extends through the body of the female component.

Preferably also the actuation means are adapted to control movement of the housing within the body of the female component.

Conveniently the actuation means comprises a cylinder having a piston moveable within the cylinder.

Advantageously the connector further comprises biasing means for retaining the actuation means in a first condition and locking means for retaining the actuation means in a second condition.

Preferably the biasing means comprises a spring.

Advantageously the locking means comprises a locking member adapted to be moved by the actuation means between a locking position and a release position.

Conveniently the actuation means further comprises a stop member adapted to cooperate with the locking means for retaining the actuation means in the second condition.

Conveniently the actuation means comprises a release member for moving the locking member out of co-operating engagement with the stop member to return the actuating means to the first condition.

According to a further aspect of the present invention there is provided a connector for connecting electrical power and/or control systems to subsea or surface infrastructure said connector comprising a male component and a female component, the male and female components comprising cooperating mating surfaces, means for latching the male component to the female component to establish a physical connection between the components and further means to establishing an electrical connection between the components, the arrangement being such that in use, the physical connection is made before the electrical connection when the male and female components are assembled and the electrical connection is broken before the physical connection is broken when the components are disassembled.

Preferably the female component comprises means for latching the male component in position within the female component.

Preferably also, the female component comprises an electrical connector which can be raised or lowered within the female component to made an electrical connection across the connector when the male component is latched into the female component.

Advantageously the movement of the electrical connector within the female component causes latching of the male component into engagement with the female component and subsequently engagement of the electrical connection between the male and female components.

By providing the operation of establishing both the physical connection between the components and the electrical connection across the components in a single stepwise operation, the male component can be positively gripped in the female component before the electrical connection is completed which aids correct alignment of the components and avoids damage of the male and female components through misalignment. Furthermore, on releasing the connector, a single movement of the means to establish the electrical connection causes firstly the electrical connection between the male and female components to be broken before releasing the male component from the female component. This further ensures that the electrical connection elements of the male and female components are not damaged during release as they are released whilst the male component is still firmly held in the female component.

Preferably the means for establishing a physical connection between the male and female components is provided externally on the components and the means for establishing an electrical connection between the components is provided internally on the components. Thus the external connection is made initially followed by the internal connection. This shields the internal components from damage during connection or disconnection operations.

Advantageously the means for latching the male component in position within the female component comprises a lever. Preferably the lever may be biased either in the inwards or outwards direction. Preferably also the bias may be moved from the inwards to the outwards direction. Most preferably the lever is biased inwards during initial movement of the means for establishing an electrical connection across the connector. Advantageously the lever is locked in the inwards biased position.

Preferably during release of the connector the bias on the lever is reversed during downwards movement of the means for establishing an electrical connection.

Advantageously the means for biasing the lever is a spring. Alternatively the spring may be replaced by a cam or by a fixed linkage.

Features of the first aspect of the invention may also be incorporated into the second aspect of the invention and features of the second aspect of the invention are similarly considered suitable for incorporation into the first aspect of the invention.

Preferably movement of the actuating means from the second condition to the first condition initially releases the electrical connection between the male and female components before releasing the mechanical connection between the components.

This invention is designed to provide a subsea disconnect/connect functionality for a subsea mateable electrical connector that will safely perform an EQD regardless of the orientation of the connecting cable. Further the connector is capable of releasing in the event that the cable becomes taught in any direction (up to the system damaging limits).

An embodiment of the invention will now be described with reference to and as shown in the accompanying drawings in which:

FIG. 1 is a schematic view of a connector according to a first aspect of the present invention;

FIG. 2*a* is a schematic view of the female component of the connector of FIG. 1;

FIG. 2*b* is a schematic view of the female component of FIG. 2*a* with the outer cover removed;

FIG. 2*c* is a part cross-sectional schematic view of the female component of FIG. 2*b;*

Figure 1:
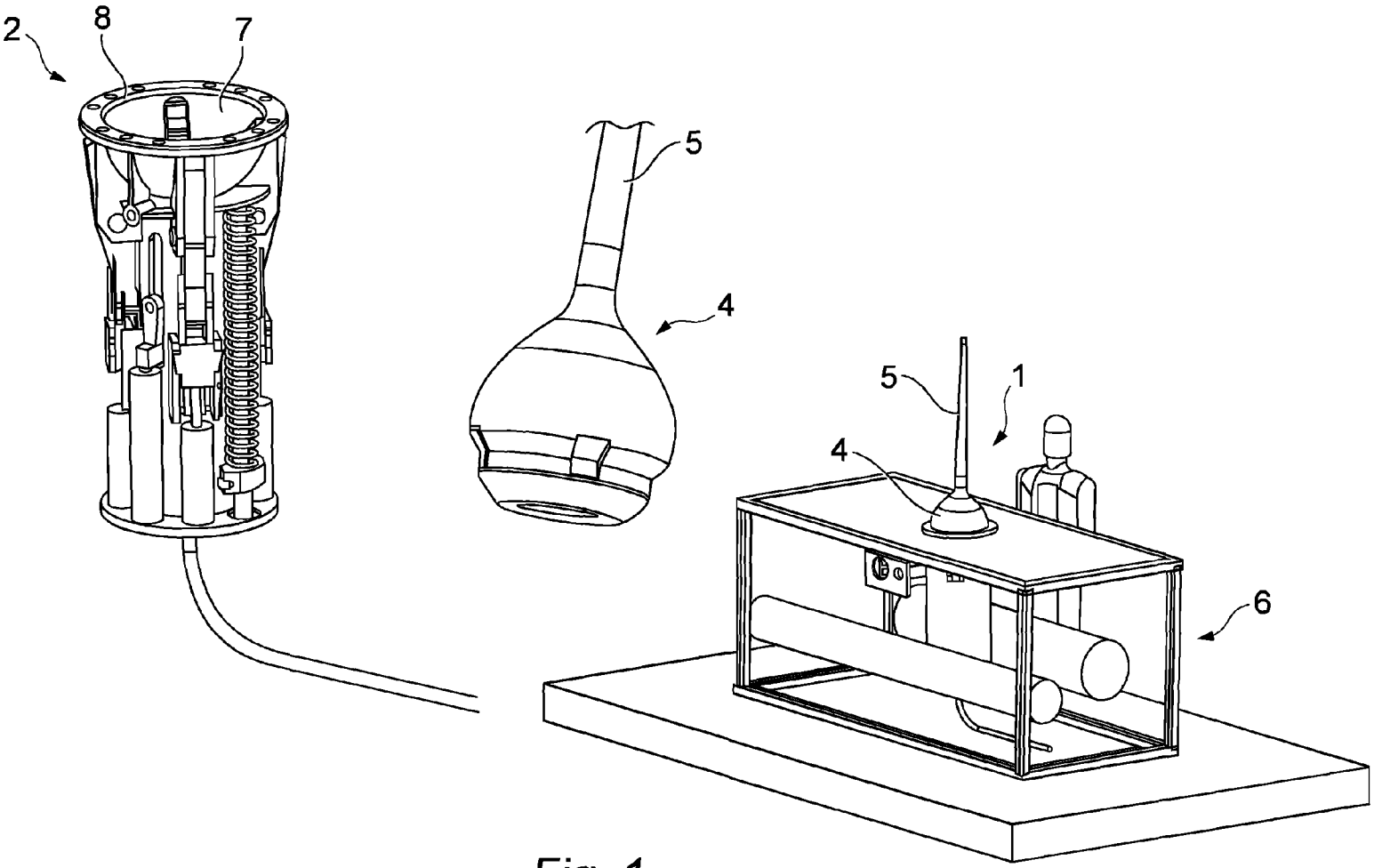

Turning to FIG. 1 there is shown a connector 1 according to one aspect of the present invention for connecting infrastructure on the sea bed to surface processing equipment to provide electrical power and control to the subsea infrastructure.

The connector generally comprises a female component 2 mounted within a substantially tubular housing 3 and a male component 4 which is mounted on the end of a flexible line 5. In a typical configuration the housing of the female component is mounted in a fixed position on a subsea installation 6 and the male component is mounted on the end of a flexible line 5 which extends from a surface based facility or vessel such as an FPSO to the subsea installation.

Figure 2C:
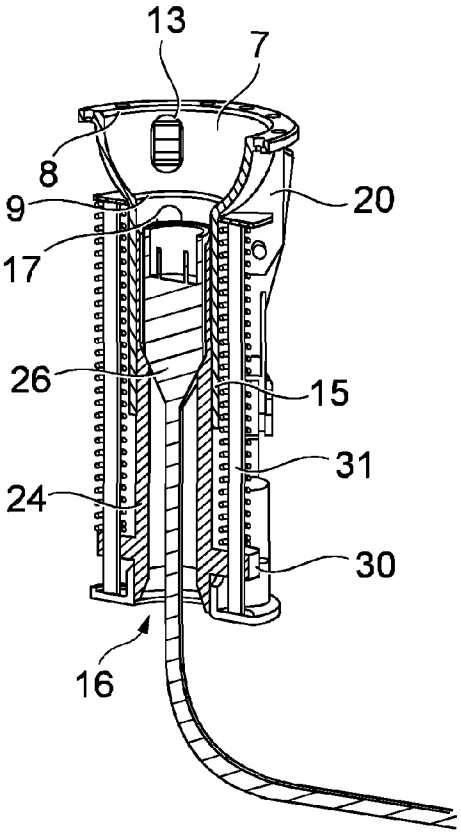
Figure 2B:
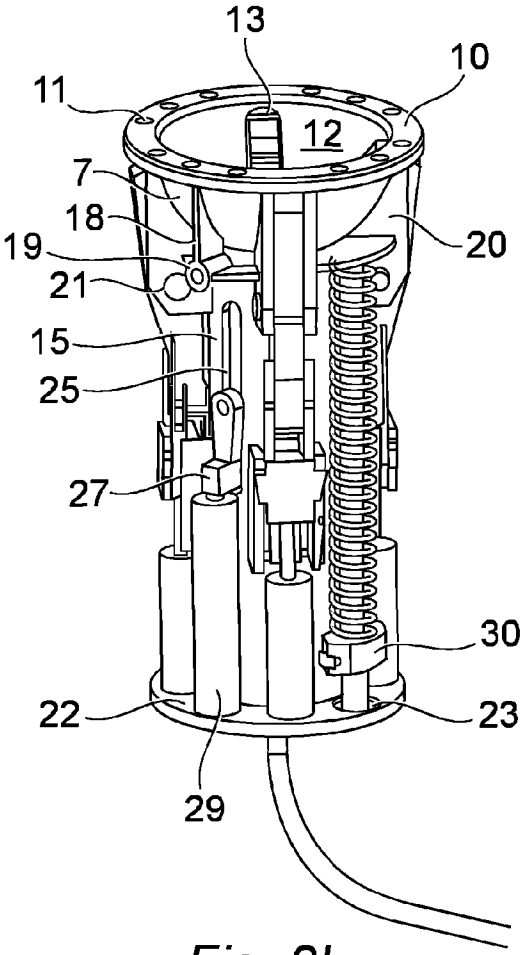
Figure 2A:
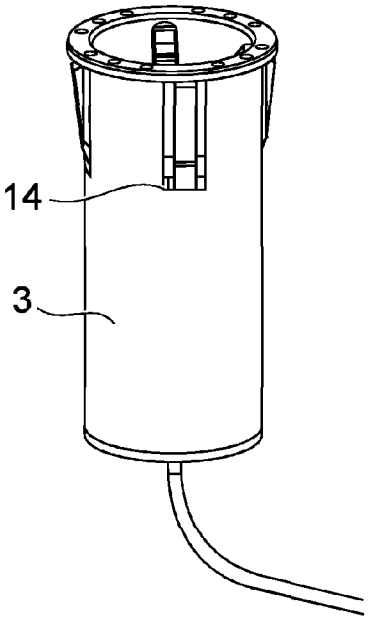

The female component comprises a substantially semi spherical receptacle 7 or cup as shown in FIG. 2 which is open at both ends, the upper opening 8 being of a greater diameter than the opening 9 in the lower end (in use) of the receptacle.

The receptacle has an annular horizontal flange 10 extending radially from the upper surface. A plurality of apertures 11 are provided in the flange, the purpose of which will be described further below. In this embodiment the apertures may be provided in groups of three in each quarter of the flange but it is envisaged that the number of apertures and the placement around the flange may be modified as required.

The inner surface 12 of the receptacle of the female component has a substantially spherical concave geometry and has a smooth surface generally free of features which extend directly from the surface. One or more apertures 13 or windows are provided around the inner wall of the receptacle of the female component, one of which is shown in FIG. 2 as will be described further below. The aperture(s) are provided at a position slightly closer to the top lip of the female component than the bottom edge and are generally rectangular in form. In the illustrated embodiment 4 such apertures are equispaced around the wall of the receptacle.

The female component of the connector is mounted in the upper part of a substantially tubular housing 3 which is open at the top end to receive the female component in a tight fit arrangement. Rectangular apertures 14 extend from the upper edge of the housing part way longitudinally along the housing. In this embodiment 4 such apertures are equispaced around the housing although other numbers are contemplated in different embodiments and they correspond in angular spacing to the apertures in the receptacle wall.

The housing comprises a protective sleeve or cover which may be formed of any suitable material such as plastic or steel FIG. 2 shows a view of the female component with the outer housing 3 removed and from this view it can be seen that a substantially tubular body 15 extends from the lower opening 9 of the female component of the connector. The tubular body 15 has a diameter substantially matching that of the open lower end of the receptacle 7 of the female component and may be integral with the receptacle or may be mounted thereto through standard fixings (not shown).

Figure 3:
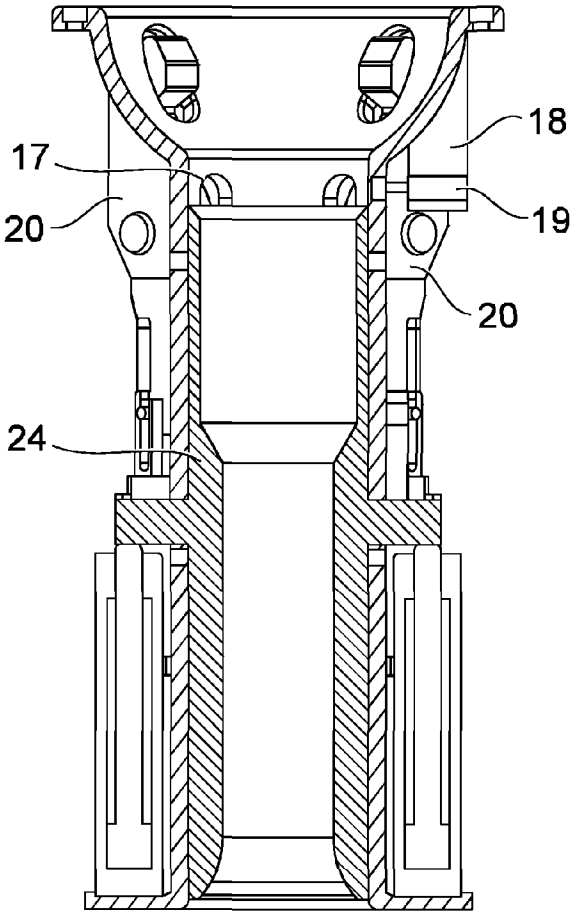
FIG. 3 is an enlarged view of the internal components of the female connector of FIG. 2.
Figure 6:
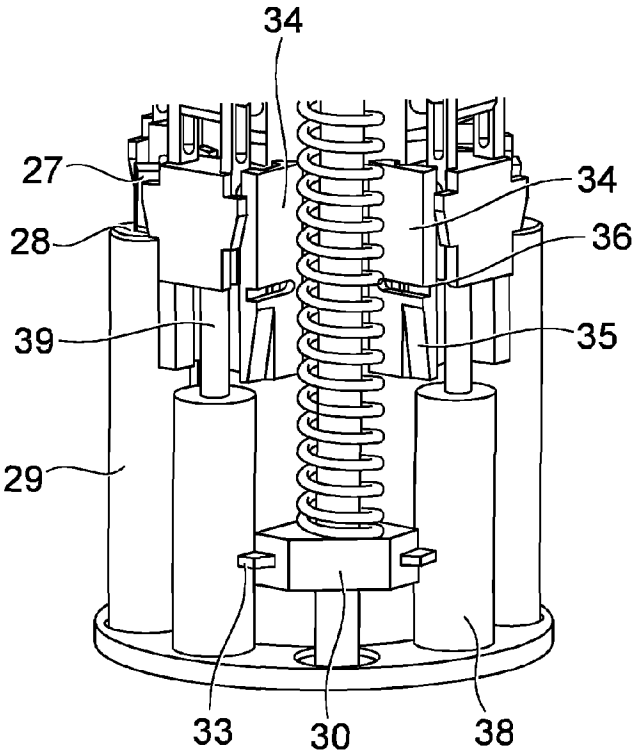
Figure 5:
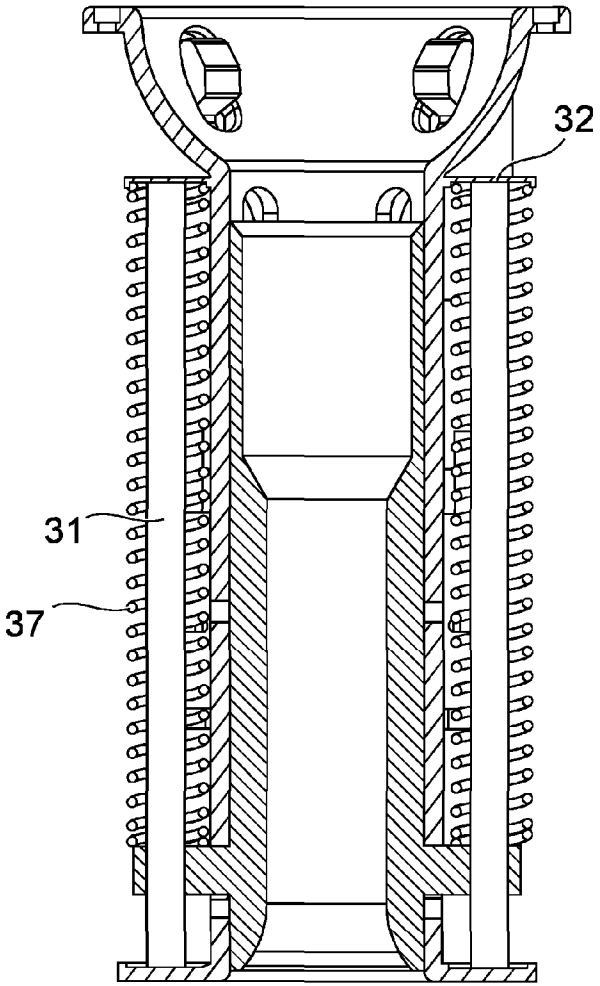
FIG. 5 is a further part cross-sectional view of the female component of FIG. 2, FIGS. 6-8 are enlarged view of the parts of the actuation mechanism of the connector of FIG. 1.

The tubular body is shown in cross section in FIG. 3. A throughbore 16 extends from the lower end of the receptacle of the female component through the tubular body.

Apertures 17 are provided through the tubular body adjacent to the junction between the tubular body 15 and the lower end of the receptacle 7 of the female component and a downwardly depending flange 18 is provided on the underside of the receptacle which has a horizontal throughbore 19 axially in line with one of the apertures in the tubular member. A plurality of such downwardly depending flanges may be provided around the outer surface of the receptacle.

Pairs of downwardly depending guide plates 20 extend from the underside of the receptacle 7 of the female component, one of either side of each of the aperture 13 through the receptacle. The guide plates are generally rectangular in form and extend between the outer surface of the tubular body 15 through the apertures 14 in the outer tubular housing 3 when this is in place. Each pair of guide plates has an aperture 21 in a lower portion thereof which are aligned on each side of the aperture 14 as will be described further blow.

The lower end of the tubular body 15 terminates in a base plate 22 which has an outer diameter substantially similar to that of the upper annular flange 10. When the outer housing 3 is in place as shown in FIG. 2, the housing extends between the underside of the flange 10 and the upper surface of the base plate 22.

The surface of the base plate may be provided with a plurality of shallow recesses 23 for mounting or locating control elements of the female component to be described further below.

The female component further comprises an inner control element 24 which is substantially tubular in form with a diameter slightly smaller than that of the tubular body 15 to allow the inner control element to be slidably mounted within the tubular body. This inner control element 24 is shown in more detail FIGS. 3 and 13.

A plurality of axial slots 25 are provided in the tubular body to allow selected portions of the inner control element 24 mounted within the tubular body to extend partially there through. In this embodiment eight slots at different axial and lateral positions are provided as will be described further below.

An electrical coupler 26 is mounted within the upper portion of the inner control element 24 which can move between a lower position where the coupler is retracted below the part-spherical surface 7 of the female component and an upper position in which the upper end of the coupler extends into the receptacle of the female component.

The inner control element 24 comprises two arms or stubs 27 which extend radially outwardly from the outer surface of the element and extend through two of the opposed slots 25 in the tubular body 15. The arms rest upon piston rods 28 which reciprocate within primary or engagement cylinders 29 mounted upon the base plate 22 of the tubular body such that as the piston rods are extended from the cylinders the arms 27 are pushed upwardly in the slots and the inner control element 24 with the electrical coupler 26 mounted therein is moved between the lower and upper positions. In this embodiment the arms are not connected to the piston rods although modified embodiments are envisaged where a permanent connection is provided.

Figure 13:
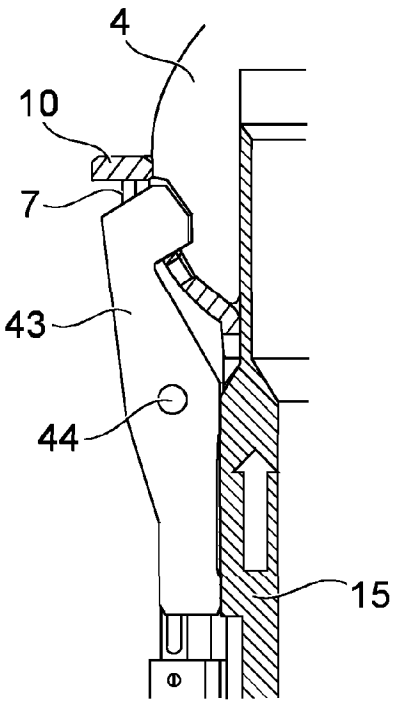
FIGS. 12 and 13 illustrate the connector of FIG. 1 in a locked or secure mode.
Figure 12:
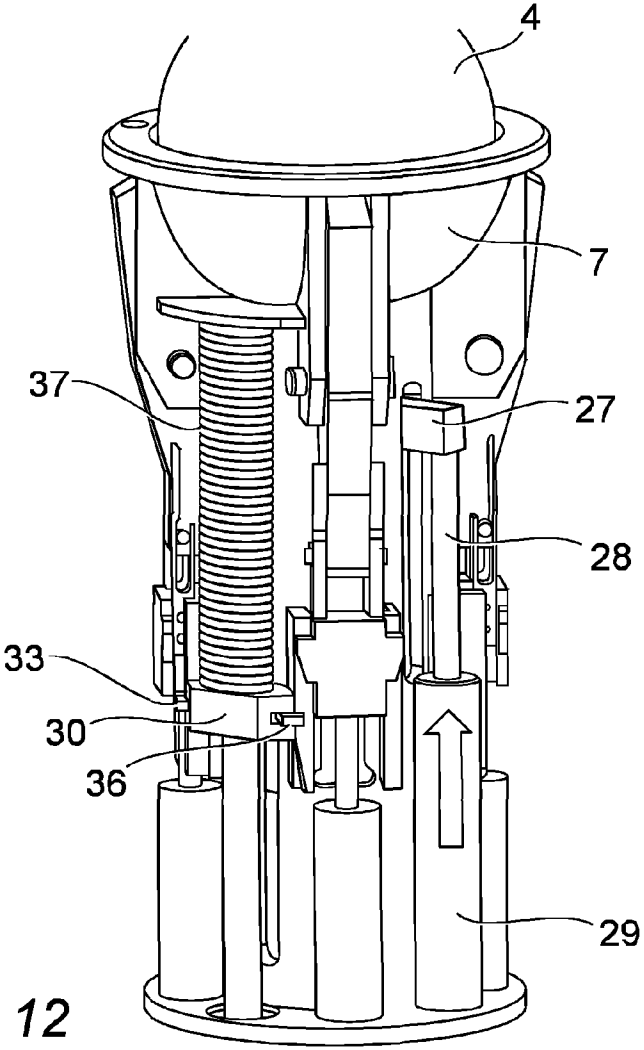
Figure 15:
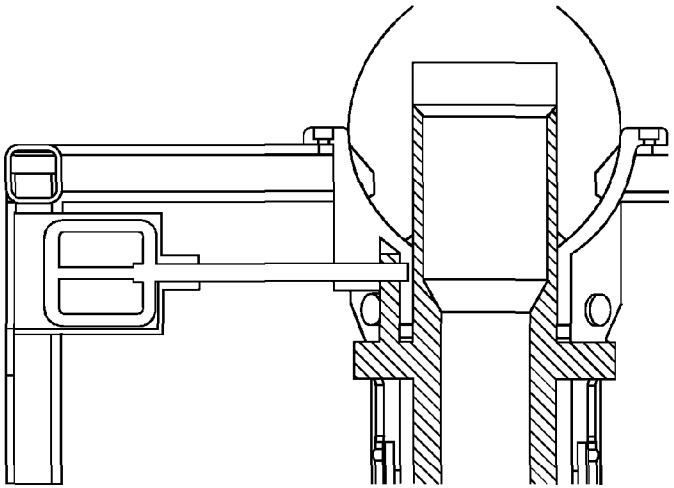
FIGS. 15 and 14 illustrate the connector of FIG. 1 is a set mode.

The inner control element has an outer profile which is shown in FIG. 13. The outer diameter of the element is stepped such that the outer diameter decreases from a point approximately two thirds from the bottom end of the element adjacent the base plate 22 towards the top end of the element.

The inner control element 24 further comprises retaining means in the form of two latch plates or blocks 30 which are generally rectangular in form and extend through slots 25 in the lower portion of the tubular body. Each latch plate has a through bore (not shown) extending between the upper and lower surfaces of the latch plate. The latch plates are mounted on substantially circular guide rods 31 that extend between the base plate 22 of the housing and an upper stop member 32 which is mounted on the guide rod slightly below the under surface of the receptacle 7 of the female component.

Locking means are provided on the latch plates 30 to hold the latch plates in a selected position along the guide rod 31. The locking means comprise a retractable tongue 33 which extends from each end of the latch plate, the tongues being spring biased outwardly from the ends of the latch plates but retractable within the body of the latch plate upon application of a force to overcome the internal spring bias.

Latch guides 34 are mounted adjacent to the guide rods 31 and part way along the guide rods and comprise a generally rectangular guide surface with a cam ram 35 in the lower surface thereof. The cam ramp tapers towards the guide rod.

A groove 36 is provided in the latch guide at a position above the cam ramps 35 and into which the locking means 33 of the latch plates can extend when the latch plates are moved along the guide rods to the selected position.

A coil spring 37 is mounted on each guide rod and extends between the upper surface of the latch plate 30 and the under surface of the stop member 32 such that upon raising the inner control element 24 within the tubular body, the latch plates 30 are pulled upwards along the guide rods and the springs 37 are compressed between the latch plates and the stop members.

Four secondary or release cylinders 38 are mounted around the base plate 22 of the tubular member, each secondary cylinder being located between one of the primary engagement cylinders 29 and a guide rod 31.

A piston rod 39 is slidably mounted within each secondary cylinder for reciprocation within the cylinder and extends from the upper end of the cylinder. A release member 40 in the form of a cam follower is mounted on the upper end of the piston rods of the release cylinders. The release member comprises a substantially rectangular body with two arms 41 extending outwardly from the body between a pair of latch guides 34. The lower surface 42 of the arms tapers from the lower end of the release member outwardly towards the ends of the arms.

The release members slide between the guide plates 20 and the extending arms of the release members extend beyond the ends of the groove 36 in the surface of the latch guides as described further below.

A locking lever 43 is mounted above each of the release members 40 and is coupled to the upper surface of the release members through a spring 44.

In the illustrated embodiment there are four levers 43, each one mounted above a release member. The levers are mounted between the pairs of depending guide plates 20 on the underside of the receptacle 7 of the female component and are fixed in position by a bolt or pivot pin 45 which passes through the apertures 21 in the lower ends of the guide plates and corresponding apertures in the levers. Each lever can move between a retracted position in which the upper end of the lever is held clear of the inner surface of the receptacle 7 of the female component and a deployed position in which the upper end of the lever extends through one of the apertures or windows 13 in the receptacle of the female component.

Figure 8:
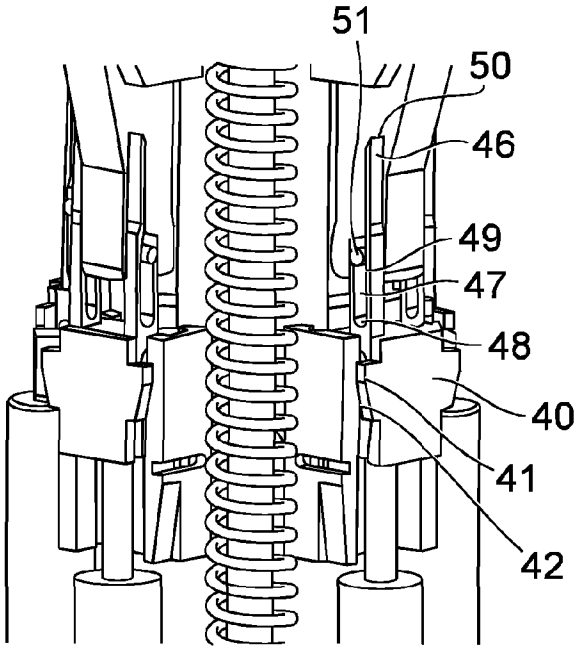
Figure 7:
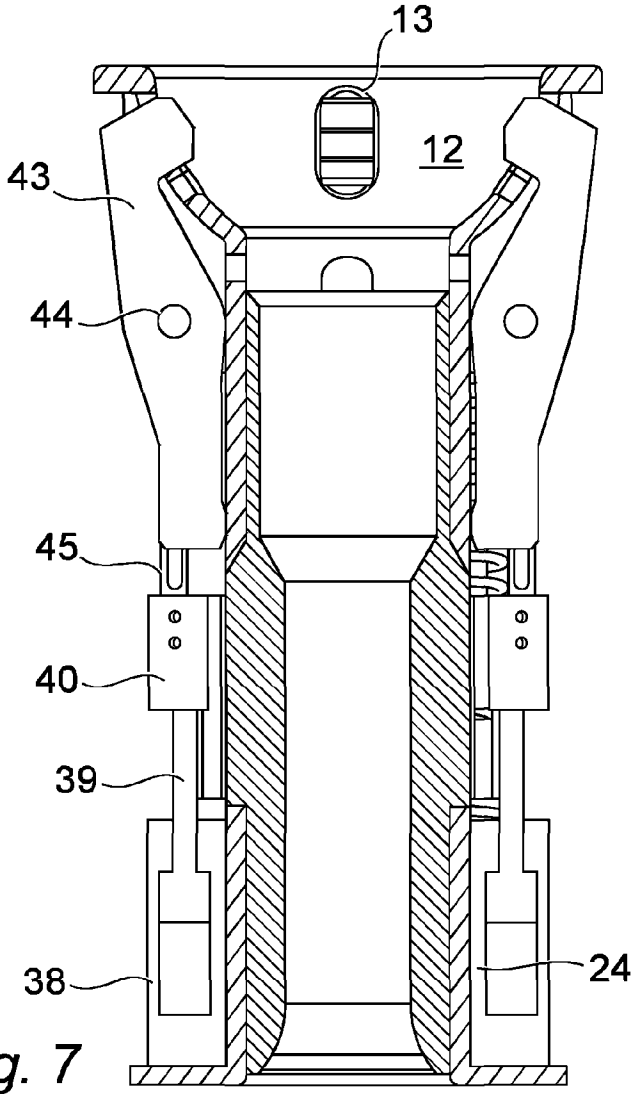
Figure 10:
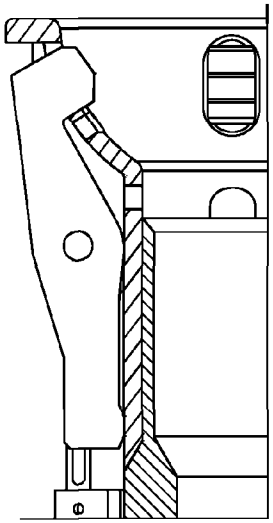
FIGS. 9 and 10 illustrate the connector of FIG. 1 in a starting condition.
Figure 9:
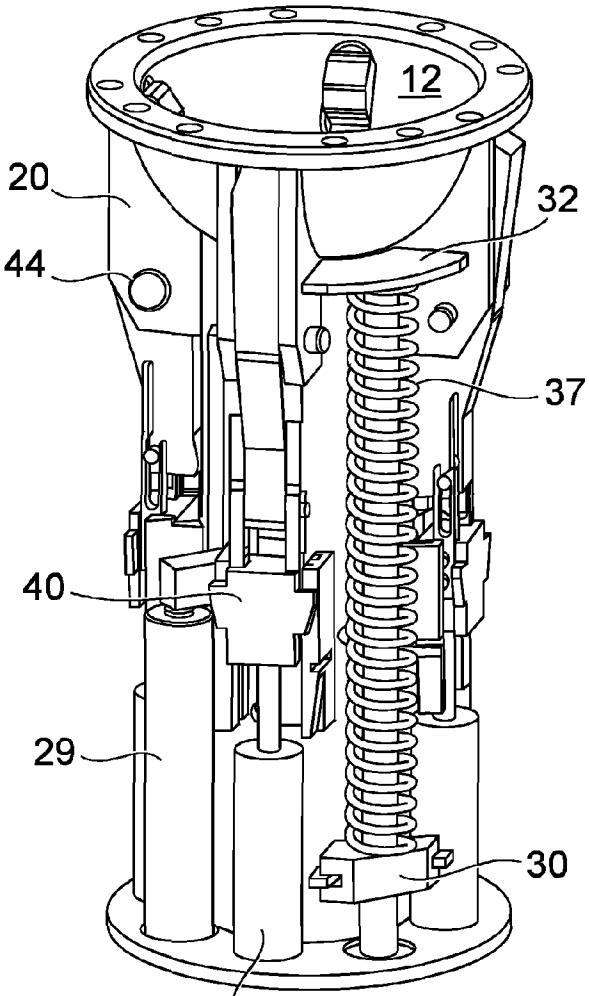
Figure 11:
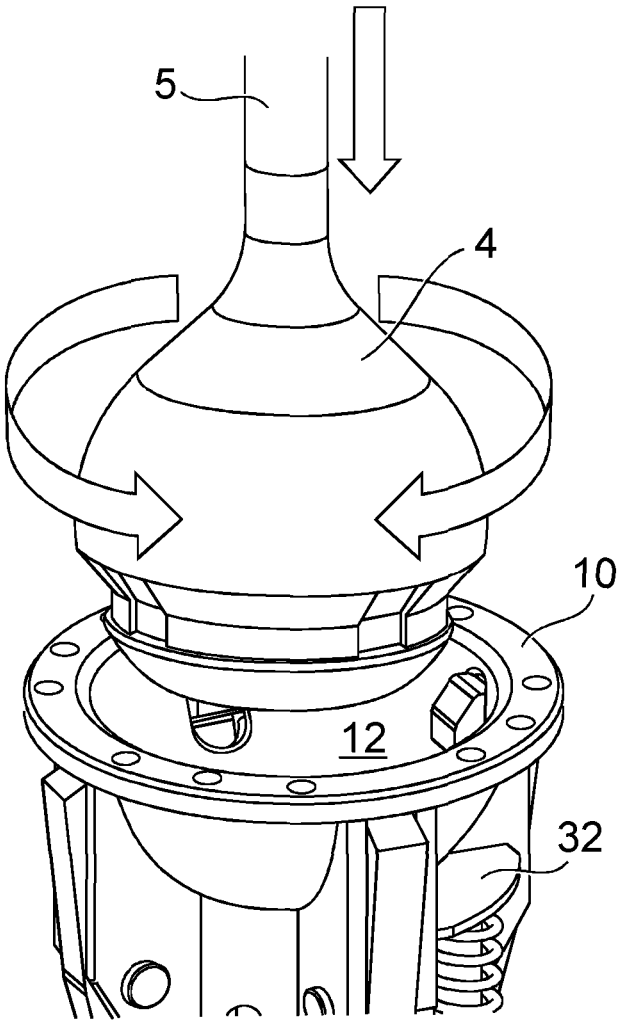
FIG. 11 shows the connector of FIG. 1 in an engagement mode.

The spring 44 comprises a pair of limbs 46, 47 mounted to the upper surface of the release member 40 or to the arms of the release member. As shown in FIG. 8, a spring is mounted on either side of the lower portion of the lever. Each spring comprises a first limb 46 and a second limb 47. The limbs of the spring lie substantially parallel to each other and are connected together at one end to form the body 48 of the spring. Preferably the limbs of the spring are integrally formed with the body. In the illustrated embodiment the spring is substantially U shaped in form such that a slot 49 is defined between the two limbs and the first limb is of a longer length than the second limb. The distal portion of the first limb 50 which extends beyond the free end of the second limb is stepped inwardly towards the lever.

Figure 14:
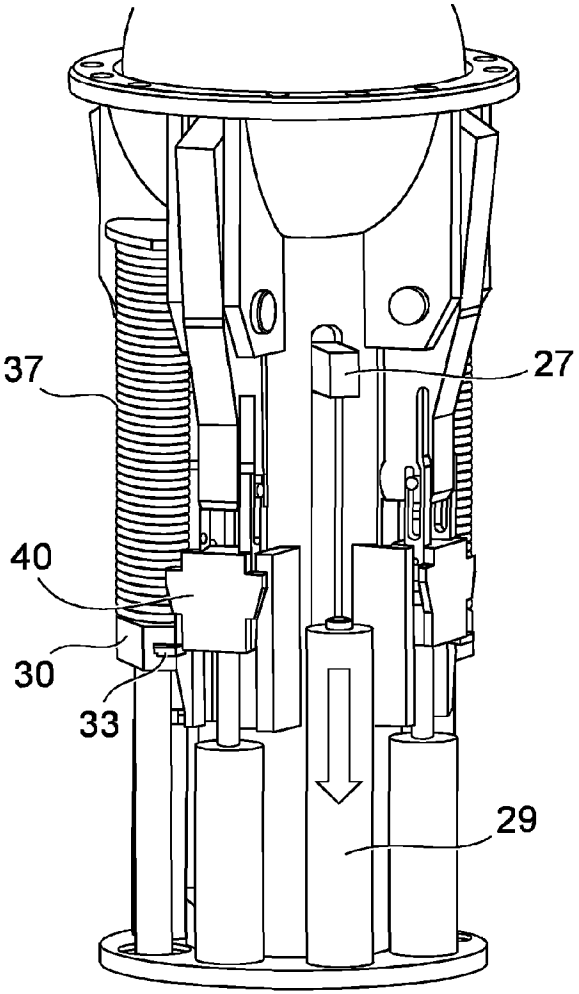
Figure 17:
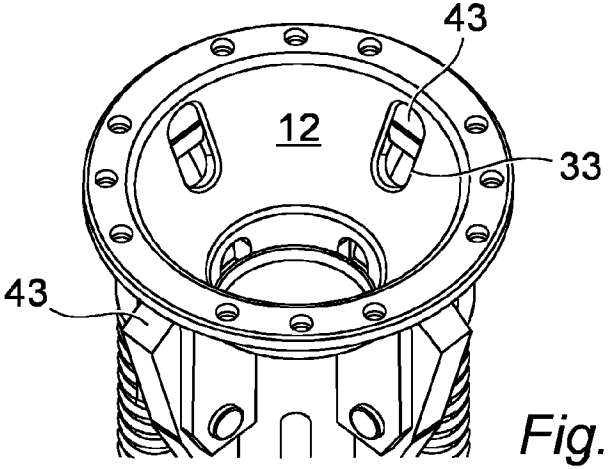
FIGS. 16-18 show parts of the connector of FIG. 1 in a release condition.
Figure 18:
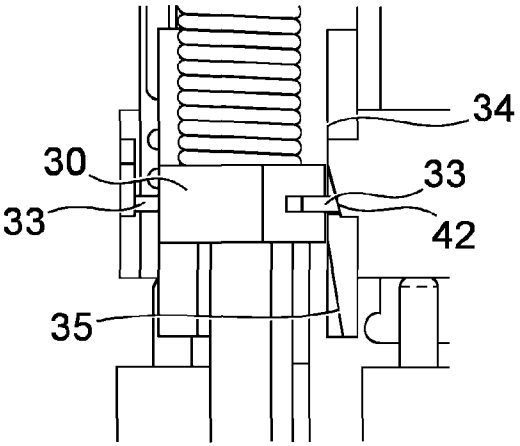
Figure 16:
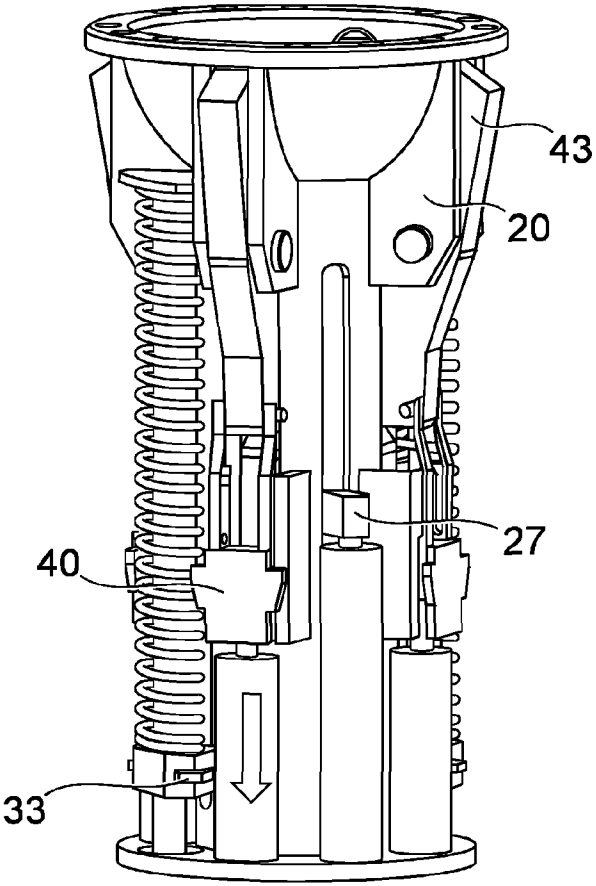
Figure 19:
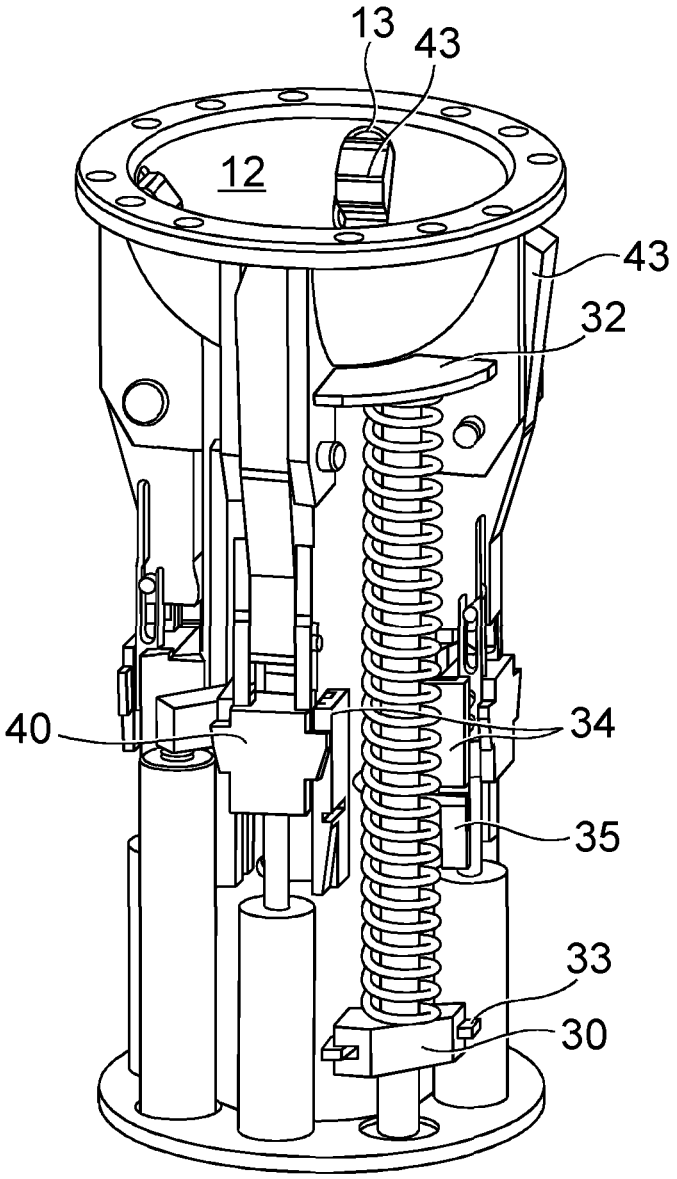
FIG. 19 shows the connector of FIG. 1 in a re-set condition.

The limbs of the spring act on an actuating pin 51 located at the lower end of the lever 43 to move the lever between the retracted and deployed conditions. In the retracted condition which is shown in FIG. 16, the distal end 50 of the first limb of the spring abuts the actuating pin 51 of the lever and as this end of the first limb is stepped inwards towards the lever, a force is applied to the lower end of the lever to force the lever to pivot around the bolt or pivot pin 45. In the deployed condition which is shown in FIG. 14, the actuating pin 51 is located in the slot 49 between the two limbs and as such, the lower end of the lever 43 is free to move radially outwardly such that the lever pivots around the pivot pin 45 to push the upper end of the lever through the aperture 13 in the receptacle 7 of the female component.

Figure 4:
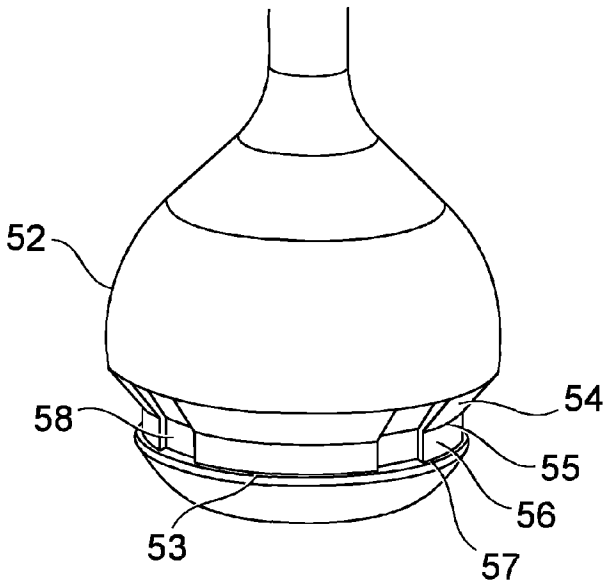
FIG. 4 is an enlarged view of part of the male component of FIG. 1.

The male component of the connector is shown in FIG. 4 and comprises a bulbous body 52 having a substantially spherical profile which has a radius of curvature which substantially matches that of the inner profile of the receptacle 7 of the female component.

A horizontal groove 53 is formed around the lower end of the male component. In the illustrated embodiment the groove comprises an upper tapered wall 54 which tapers radially inwardly from the outer surface of the male component and terminates in a shoulder 55 with a vertical wall 56. At the lower end of the vertical wall, a horizontal rim 57 is formed and the outer surface of the male component tapers inwardly below the rim such that the outer diameter of the male component below the circumferential groove is smaller than that of the male component above the groove.

In this embodiment four recesses 58 are provided in the groove 53 which are shaped and positioned to cooperate with the upper end of the locking levers 43 of the female component.

The operation of the connector will now be described with reference to FIGS. 9 to 16.

Prior to connection of the male and female components, the engagement or primary cylinders 29 of the female component are retracted such that the electrical coupler 26 within the inner control element 24 of the female component is in the lower retracted position and the locking tongues 33 of the latch plates 30 are extended from the latch plates but below the position of the guide plates 20. The piston rods 39 upon which the release blocks 40 are mounted are set in the raised position such that the levers 43 are in the deployed condition as described above and the upper end of levers are biased inwardly and extend through the apertures 13 in the surface of the receptacle 7 of the female component.

The male component 4 is then brought towards the open upper end of the female component 2 and stabbed into position within the female component. As the male component 4 enters the female component, the lower outer surface of the male component slides over the free end of the levers and pushes the levers back out of the apertures 13 against the bias of the springs 44. As the male component is pushed further into engagement with the female component, the radial groove 53 of the male component comes into alignment with the apertures 13 of the female component and the upper end of the levers moves back under the spring bias 44 through the apertures 13 and into the radial groove 53.

This provides an initial mechanical connection between the male and female components. The male component 4 can be axially rotated within the female component until the recesses 58 in the axial groove of the male component line up with the upper end of the levers 43 at which time the end of the levers move into the recesses 58 and prevent further lateral or axial movement of the male component within the female component.

The primary or engagement cylinders 29 are then actuated by an ROV to extend the piston rods 28 of the cylinders which in turn forces the lateral arms 27 of the inner control element 24 upwardly along the slots 25 in the tubular body 15.

Simultaneously the latch plates 30 are lifted by the movement of the inner control element 24 along the guide rods 31 and the springs 37 around the upper ends of the guide rods are compressed between the upper surfaces of the latch plates 30 and the under surface of the stop members 32.

As the latch plates 30 move upwardly along the guide rods, the retractable tongues 33 run up the tapered surface 35 of the latch guides 34 until they reach the locking groove 36 where they spring into the groove. At this time further upward movement of the latch plates and subsequently the inner control element and electrical coupler is restricted.

Referring to FIG. 13, as the control element 24 is raised, the raised external profile on it is forced under the lower end of the levers 43 so providing a positive lock of the male half of the connector into the female prior to continued axially movement bring the electrical coupler into engagement. This feature is there to provide a robust positive mechanical lock on the male half which is initially latched by the inward spring bias only.

As the electrical coupler 26 is raised towards the upper position, the upper end of the coupler extends into the receptacle 7 of the female component and into the lower end of the male component 4 where it engages with corresponding electrical couplers in the male component thereby providing a secure electrical connection across the connector.

The primary engagement cylinders 29 are then retracted by an ROV as shown in FIG. 14 leaving the electrical coupler 26 in the raised position within the tubular body 15 of the female component through the engagement of the levers retractable tongues 33 of the latch plates in the grooves 36 in the latch guides 34.

At this time a secondary locking feature can be provided by feeding a locking member through the bore 19 in the downwardly depending flange 19 of the female component and a corresponding locking eye 59 on a portion of the inner control element which is shown in FIG. 3.

As can be appreciated above, the mechanical connection between the male and female components of the connector is made up before the electrical connection is completed.

This ensures that the spherical profile of the connector is made up prior to the axial engagement of the electrical coupler housing 24 and hence the electrical connector mounted therein.

When the connector is to be released, the secondary or release cylinders 38 are activated and the piston rods 39 are retracted into the cylinders such that the release members 40 are pulled downwardly along the latch guides 34 and pull the springs 44 downwardly such that the actuation pin of the levers moves into the release position in the spring adjacent the distal end of the first limb of the spring. In this position, the lower portion of the lever 43 is biased inwardly such that the lever pivots around the bolt 45 and the upper portion of the lever is now biased to move outwardly from the receptacle 7.

As the tapered arms 41 of the release members pass over the locking grooves 36 in the latch guides 34 they push the retractable locking tongues 33 back into the latch plates 30 and allow the latch plates to move downwardly under bias of the compressed springs 37 thereby pulling the electrical coupler 26 downwardly within the tubular body 15 of the female component.

The profile on the outer surface of the control element 24 as shown in FIG. 13 is such that as it moves downwardly under the action of the spring the levers 43 are initially still held in the locked position (though spring biased outward) while the electrical connector is moving clear in the vertical direction only. Once the electrical connector is disengaged and clear a tapered section on the outer profile of the control element passes the lower end of the levers 43 so allowing them then to move inward under the action of the spring bias and so release the male member.

As the electrical coupler 26 is disengaged after the levers have already been moved to the release position, the male component can be pulled out of mechanical engagement with the female component. The part spherical geometry of the male and female components allows the male component to be pulled clear of the female component from any orientation such that movement of an FPSO on the surface which results in a corresponding change in the orientation of the male component will not prevent the male component from being easily pulled clear of the female component when required without damage to either component.

In the embodiment described above, the male to female interface is substantially spherical in its geometry. The female component is configured with a substantially spherical concave geometry and the male is configured with the mating substantially spherical convex geometry. The spherical interface allows the connection to be immediately free once functioned regardless of the orientation of the connecting cable or the amount of tension applied at the point EQD. This also includes zero tension or compression.

The plurality of dogs or locking levers or arms 43 are spaced around the periphery of the concave spherical profile and move inwards through the windows 13 in the profile to engage with and disengage from the male component. As shown this movement is achieved by means of the levers being mounted on a pivot pin allowing rotation about the pin to affect inward/outward movement of the locking profile of the dogs.

The tubular body below the concave spherical geometry houses the electrical coupler housing which can move axially up and down in the tubular body. This housing mounts one half of the electrical coupler, the other being mounted in the male component, and has an open through bore to allow the electrical cable to pass through.

A full 360° lock groove on the male spherical profile allows it to engage with the levers in any axial orientation about the connector axis. A further 4 individual recesses for final orientation and lock of the male component into the female component are also incorporated. This configuration is designed to allow the connection to be made up initially on the 360° groove only which provides a "loose" connection while personnel/ROV manipulate the male to the final connect orientation. The initial connection is maintained by the inward spring bias of the lever locking profile.

Whilst the orientation of the two halves of the connector are integral with the connector it is envisaged that some embodiments may have an external feature to provide orientation about the vertical axis which element or feature would then be retracted after the connector was both mechanically and electrically secured so as not to interfere with the free and unobstructed separation of the two halves of the connector.

The connection mechanism allows the spherical profile to be made up prior to the axial engagement of the coupler housing and hence the electrical connector mounted therein. On EQD the coupler housing is retracted which initially causes retraction of the coupler housing and hence disconnection of the electrical connector, and continued travel then releases the dogs so allowing the male spherical profile to be released.

The interface between the levers and the outer profile of the electronic coupler housing is configured such that the initial movement locks the levers in position, with continued travel then keeping them locked and engaging the electrical connector mounted in the assembly. This ensures that the connection is secure and the engagement of the electrical connector halves is by axial travel only. The cylinders 38 are not fixed to the coupler housing and once extended to latch the connector are retracted back to their start position.

On disconnect the cylinders connected to the release blocks pull the blocks downward. Initial movement of the blocks causes the dog spring to switch from an inwardly biased to an outwardly biased condition. Continued movement then causes a cam face on a release member or tab actuated by the cylinder to contact and release the latch plates so allowing the springs to force the coupling housing downward. This downward movement is the reverse of the upward in that the initial movement pulls the electrical connector axially downward and only when it is clear does the dog to coupler housing interface disengage so allowing the now outwardly sprung dogs to release the male connector.

Following the disconnect the release blocks are functioned back up to clear the latch plate grooves and reset the dogs to the inwardly biased condition in preparation for reconnection.

It will be appreciated that whilst the invention has been described above with particular reference to connection of power and control systems to subsea infrastructure, it is also envisaged that the connection could equally be used in a surface application such as to connect a flexible flowline to a tanker or FPSO.

Further the invention may be used to provide a connector which may allow fluid to pass through in the open or connected condition but may cut off flow in the closed or disconnected condition. This could be used in the case of a flexible hose to a subsea structure. In this case the connector provides a fluid path rather than an electrical connection across the connector and references to forming an electrical connection above may be modified to a fluid path.

Furthermore, it will be appreciated that the springs which provide the motive force for effecting a disconnection may be replaced by cylinders operated from a suitable hydraulic source.

In the embodiment described above the male and female components of the connector have a substantially part spherical form which allows the connection between the components to be freed quickly regardless of the orientation of the connecting cable or the amount of tension applied to the mandrel of the male component. Other profiles are contemplated including convex and concave mating surfaces which are not partly spherical and also an embodiment in which the mating surfaces of each of the male and female components are substantially flat. In this embodiment the levers 43 described above may be modified to extend through each of the mating surfaces of the male and female components to lock the components together against axial or rotational movement.

Whilst the connector of the illustrated embodiment is shown with the locking arrangement mounted around the convex female component, the locking arrangement may be mounted around the concave male component with the convex female component providing a plain receptacle. In this embodiment the levers may be mounted within the male component and may extend out of the male component to engage in a mating groove profile in the female component.

In an alternative embodiment of the present invention the four locking levers may be replaced by a different number of levers. Further alternatively, the levers may be replaced with static profiled plates that achieve the movement of moving to the locking and unlocked condition by virtue of their ability to flex under the action of the coupler housing both inwardly and outwardly. The levers could also be replaced by siring mounted buttons again moved thought interaction with the coupler housing. In each case the locking feature is spring biased inwardly and held in a locked position by upward movement of the coupler housing and then forced in to the unlocked position by the downward movement of the coupler housing.

The inner control element mounts an electrical coupler which is axially engaged within the connector. The coupler may be any electrical, control or hydraulic connection, optical signal and or fluid connection or multiples of each of combinations of each that are engaged by means of axial movement.

The spring biased latch feature described above could be replaced with an external feature holding the two halves of the connector together initially to allow the levers to then be engaged or just held in position by an ROV.

In a further modification the primary or engagement cylinders may be replaced by a single unit annular piston positioned around the tubular body to provide a motive force to the tubular body in the axial direction.

The invention claimed is:

1. A connector for connecting power or control systems infrastructure, said connector comprising:

a male component and a female component, the male and female components comprising cooperating mating surfaces and means for locking the male and female components together;

wherein the locking means is retractably mounted within one of the male or female components but extendible from that component into the other of the male or female components to lock the two components together against axial and rotational movement whilst providing a snag free release when the locking means is in the retracted position;

wherein the locking means comprises a lever pivotally mounted within the female component;

actuation means comprising a housing mounted within the body of the female component; and wherein the housing is adapted to be raised and lowered within the body of the female component such that when the housing is raised, a raised external profile on the housing is forced under the lower end of the lever to lock the male and female components together.

2. A connector according to claim 1, wherein one of the male component or female components has a convex mating surface and the other has a concave mating surface.

3. A connector according to claim 1, wherein the mating surfaces of the male and female components of the connector are partly spherical.

4. A connector according to claim 1, wherein the mating surface of the male and female components are substantially flat.

5. A connector according to claim 1, wherein apertures are formed in the mating surface of the female connector.

6. A connector according to claim 5, wherein the mating surface of the male and female components are substantially flat, wherein the lever is adapted for movement between a locked condition in which the lever extends through the aperture in the mating surface of the female connecter and an unlocked condition in which the lever is retracted from the aperture.

7. A connector according to claim 1, wherein a groove is formed in the outer surface of the male member.

8. A connector according to claim 7, wherein the groove is formed in the mating surface of the male member.

9. A connector according to claim 8, wherein when the male and female components are connected, the lever is adapted to extend, by a biased force, through the aperture in the female member and into the groove of the male member.

10. A connector according to claim 8, wherein a recess is provided in the groove, the end of the lever being received in the recess to lock the male and female members together against radial movement.

11. A connector according to claim 1, wherein means are provided for applying a biasing force to the lever.

12. A connector according to claim 11, wherein the means for applying the biasing force may act on the lever in one direction in a first condition and in another, preferably opposite direction in a second condition.

13. A connector according to claim 8, wherein the depth of the groove increases within the recess.

14. A connector according to claim 1, wherein a first portion of the housing extends through the body of the female component.

15. A connector according to claim 1, wherein the actuation means are adapted to control movement of the housing within the body of the female component.

16. A connector according to claim 1, wherein the actuation means comprises a cylinder having a piston moveable within the cylinder.

17. A connector according claim 1, wherein the connector further comprises biasing means for retaining the actuation means in a first condition and locking means for retaining the actuation means in a second condition.

18. A connector according to claim 17, wherein the biasing means comprises a spring.

19. A connector according to claim 17 wherein the locking means comprises a locking member adapted to be moved by the actuation means between a locking position and a release position.

20. A connector according to claim 19, wherein the actuation means further comprises a stop member adapted to co-operate with the locking means for retaining the actuation means in the second condition.

21. A connector according to claim 20, wherein the actuation means comprises a release member for moving the locking member out of co-operating engagement with the stop member to return the actuating means to the first condition.

22. The connector of claim 1, wherein the power or control systems infrastructure is a subsea infrastructure.

23. A connector for connecting electrical power and/or control systems to subsea or surface infrastructure, said connector comprising:

a male component and a female component, the male and female components comprising cooperating mating surfaces, means for latching the male component to the female component to establish a physical connection between the components means to establish an electrical connection between the components;

wherein, in use, the physical connection is made before the electrical connection when the male and female components are assembled and the electrical connection is broken before the physical connection is broken when the connector is disassembled;

wherein the means for latching comprises a lever pivotally mounted within the female component;

actuation means comprising a housing mounted within the body of the female component; and wherein the housing is adapted to be raised and lowered within the body of the female component such that when the housing is raised, a raised external profile on the housing is forced under the lower end of the lever to latch the male and female components together.

24. A connector according to claim 23, wherein the female component comprises the means for latching.

25. A connector according to claim 23, wherein the female component comprises the means to establish an electrical connection, the means to establish an electrical connection comprising an electrical connector which can be raised or lowered within the female component to make an electrical connection across the connector when the male component is latched into the female component.

26. A connector according to claim 25, wherein the movement of the electrical connector causes latching of the male component into engagement with the female component and subsequently engagement of the electrical connection between the male and female components.

27. A connector according to claim 23, wherein the means for establishing a physical connection between the male and female components is provided externally on the components and the means for establishing an electrical connection between the components is provided internally on the components.

28. A connector according to claim 23, wherein the means for latching the male component in position within the female component comprises a lever.

29. A connector according to claim 28, wherein the lever is biased either in the inwards or outwards direction.

30. A connector according to claim 29, wherein the bias is movable from the inwards to the outwards direction.

31. A connector according to claim 30, wherein the lever is locked in the inwards biased position.

32. A connector according to claim 31, wherein, during release of the connector, the bias on the lever is reversed during downwards movement of the means for establishing an electrical connection.

* * * * *